US009565499B2

(12) United States Patent
Kamkar Parsi et al.

(10) Patent No.: US 9,565,499 B2
(45) Date of Patent: Feb. 7, 2017

(54) BINAURAL HEARING AID SYSTEM FOR COMPENSATION OF MICROPHONE DEVIATIONS BASED ON THE WEARER'S OWN VOICE

(71) Applicant: SIVANTOS PTE. LTD., Singapore (SG)

(72) Inventors: Homayoun Kamkar Parsi, Erlangen (DE); Marko Lugger, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 55 days.

(21) Appl. No.: 14/257,378

(22) Filed: Apr. 21, 2014

(65) Prior Publication Data

US 2014/0314258 A1 Oct. 23, 2014

(30) Foreign Application Priority Data

Apr. 19, 2013 (DE) ..... 10 2013 207 080

(51) Int. Cl.
*H04R 25/00* (2006.01)
*H04R 29/00* (2006.01)

(52) U.S. Cl.
CPC ..... *H04R 25/43* (2013.01); *H04R 25/407* (2013.01); *H04R 25/552* (2013.01); *H04R 29/006* (2013.01)

(58) Field of Classification Search
CPC .... H04R 25/407; H04R 25/552; H04R 29/006
USPC ..... 381/312–313
See application file for complete search history.

(56) References Cited

U.S. PATENT DOCUMENTS

| | | | | |
|---|---|---|---|---|
| 7,340,231 | B2 | 3/2008 | Behrens et al. | |
| 7,512,245 | B2 | 3/2009 | Rasmussen et al. | |
| 8,588,441 | B2 | 11/2013 | Kramer et al. | |
| 2004/0057591 | A1* | 3/2004 | Beck et al. | 381/315 |
| 2006/0262944 | A1* | 11/2006 | Rasmussen | G10L 25/78 381/110 |
| 2007/0147635 | A1* | 6/2007 | Dijkstra et al. | 381/94.1 |
| 2009/0041272 | A1* | 2/2009 | Puder | H04R 25/453 381/318 |
| 2009/0074201 | A1* | 3/2009 | Zhang | 381/92 |
| 2012/0308020 | A1* | 12/2012 | Rung | 381/60 |

FOREIGN PATENT DOCUMENTS

| | | | |
|---|---|---|---|
| DE | 102010018877 | A1 | 6/2011 |
| EP | 2040486 | A2 | 3/2009 |
| EP | 2360951 | A1 | 8/2011 |
| WO | 03032681 | A1 | 4/2003 |

* cited by examiner

*Primary Examiner* — Ahmad F Matar
*Assistant Examiner* — Katherine Faley
(74) *Attorney, Agent, or Firm* — Laurence A. Greenberg; Werner H. Stemer; Ralph E. Locher

(57) ABSTRACT

A hearing aid system is enabled for binaural microphone adjustment by way of the wearer's own voice. The hearing aid system has a first and a second hearing aid having a first and a second acousto-electric converter. The converters have a signal link with a signal processing unit which determines and compensates for signal deviations caused by the first and second acousto-electric converters on the basis of signals from the wearer's own voice. The wearer's own voice is recognized by a special facility.

8 Claims, 1 Drawing Sheet

BINAURAL HEARING AID SYSTEM FOR COMPENSATION OF MICROPHONE DEVIATIONS BASED ON THE WEARER'S OWN VOICE

CROSS-REFERENCE TO RELATED APPLICATION

This application claims the priority, under 35 U.S.C. §119, of German patent application DE 10 2013 207 080.2, filed Apr. 19, 2013; the prior application is herewith incorporated by reference in its entirety.

BACKGROUND OF THE INVENTION

Field of the Invention:

The present invention relates to a hearing aid system that includes a first hearing aid and a second hearing aid. The first hearing aid has a first acousto-electric converter and the second hearing aid has a second acousto-electric converter. The converters are configured to convert incoming acoustic signals into first and second electrical signals. Furthermore, the hearing aid system has a signal processing unit, wherein the signal processing unit has a signal link with the first and the second acousto-electric converters.

Hearing aids are wearable hearing apparatuses which are used for providing care for the hard of hearing. In order to meet the numerous individual needs, different designs of hearing aids such as behind-the-ear hearing aids (BTE), hearing aids with an external earpiece (RIC: receiver in the canal) and in-the-ear hearing aids (ITE), for example also concha hearing aids or completely-in-canal hearing aids (ITE, CIC), are made available. The hearing aids cited by way of example are worn on the outer ear or in the auditory canal. In addition, bone conduction hearing aids, implantable or vibrotactile hearing aids are however also available on the market. In this situation the stimulation of the damaged hearing takes place either mechanically or electrically.

In principle, hearing aids have as their essential components an input converter, an amplifier and an output converter. The input converter is as a rule an acousto-electric converter, for example a microphone, and/or an electromagnetic receiver, for example an induction coil. The output converter is implemented for the most part as an electroacoustic converter, for example a miniature loudspeaker, or as an electromechanical converter, for example a bone conductor. The amplifier is usually integrated in a signal processing unit.

It is known that hearing with two ears enables a person to more easily understand speech in background noise or in an echoey environment. Furthermore, binaural hearing is a primarily important prerequisite for spatial hearing and sound wave localization. Because of the significance of the binaural processes in the analysis of hearing situations it is understandable that hearing impaired persons benefit more from two hearing aids for a binaural fitting than from one single hearing aid for a monaural fitting.

The binaural signal processing reacts particularly sensitively to differences between the signals because the natural variations in the signals from both sides of the head differ only slightly in their amplitude, phase and/or frequency distribution. It is therefore in particular important that deviations are not artificially added by the signal processing in the hearing aids. In this situation the microphones first and foremost are particularly susceptible because small mechanical manufacturing tolerances can result in large deviations on account of their small dimensions. For the same reason the properties may also change during actual operation, for example as a result of contamination or material ageing. Since this effect mostly occurs unsymmetrically the impact is particularly serious.

Pairs of microphones which have almost identical properties are therefore normally assembled together during the production process. This process is however elaborate and does not prevent changes during operation.

U.S. Pat. No. 8,588,441 B2 and its counterpart European published patent application EP 2 360 951 A1 describe that, for microphones which have matching properties in a frequency range, the direction of a source is determined in that frequency range. By means of said identified source having a predefined direction it is then possible to acquire and compensate for deviations in other frequency ranges.

It is known from U.S. Pat. No. 7,340,231 B2 and its counterpart international patent application publication WO 2003/032681 A1 that hearing aids recognize the voice of the wearer in order to process it with changed parameters compared with other tones and thus to convey to the wearer of the hearing aid a familiar sound of the wearer's own voice. To this end U.S. Pat. No. 7,512,245 B2 specifies different possible ways of recognizing the wearer's own voice.

However, the problem remains that differences in the microphone properties which arise during operation are not compensated for.

SUMMARY OF THE INVENTION

It is accordingly an object of the invention to provide a hearing aid system and a method for operating the hearing aid system which overcome the above-mentioned disadvantages of the heretofore-known devices and methods of this general type and which also enable simple and reliable operation over an extended period of usage.

With the foregoing and other objects in view there is provided, in accordance with the invention, a hearing aid system to be worn by a hearing aid wearer, the hearing aid system comprising:

a first hearing aid and a second hearing aid, said first hearing aid having a first acousto-electric converter configured to convert an incoming acoustic signal into a first electrical signal, and said second hearing aid having a second acousto-electric converter configured to convert an incoming acoustic signal into a second electrical signal;

a signal processing unit connected, by way of a signal link, with said first and second acousto-electric converters;

said signal processing unit being configured to determine and to compensate for signal deviations caused by said first and second acousto-electric converters in the first and/or second electrical signals on the basis of the first and second electrical signals from the wearer's own voice;

a facility for recognizing the wearer's own voice configured for recognizing the wearer's own voice, said facility having a signal link with said first and the second acousto-electric converters and being configured to signal to said signal processing unit a recognition of a signal from the wearer's own voice.

In other words, the hearing aid system according to the invention has a first and a second hearing aid. The first hearing aid has a first acousto-electric converter and the second hearing aid has a second acousto-electric converter. The converters are configured to convert incoming acoustic signals into first and second electrical signals. Furthermore, the hearing aid system has a signal processing unit, wherein the signal processing unit has a signal link with the first and the second acousto-electric converters. The signal processing unit is designed to determine and to compensate for signal deviations caused by the first and second acousto-electric converters in the first and/or second electrical signals on the basis of the first and second signals from the wearer's own voice.

In this situation the hearing aid system according to the invention advantageously utilizes the fact that the wearer's own voice is characterized by special features, in particular the symmetry to two hearing aids on the two ears of the wearer. It is thus particularly simple to identify deviations between the two electrical signals and then to also compensate for said deviations in the signal processing unit.

The method for operating the hearing aid system shares these advantages.

In a preferred embodiment the hearing aid system furthermore has a facility for recognizing the wearer's own voice. The facility for recognizing the wearer's own voice has a signal link with the first and the second acousto-electric converter and is designed to signal the recognition of a signal from the wearer's own voice to the signal processing unit.

Such a type of facility for recognizing the wearer's own voice makes it possible in an advantageous manner that the signal processing unit also determines and compensates for the deviations of the first and second electrical signals during actual operation without for example the wearer or another person starting an adjustment operation.

In a possible embodiment the facility for recognizing the wearer's own voice is designed to recognize a signal from the wearer's own voice on the basis a level of the first and/or the second electrical signal.

Recognition on the basis of the level is particularly simple to implement in this situation.

In a conceivable embodiment the facility for recognizing the wearer's own voice is designed to recognize a signal from the wearer's own voice on the basis of a phase relationship of the first and second electrical signals relative to one another.

The phase relationship is particularly sensitive with regard to the position and recognition of the wearer's own voice can therefore take place particularly reliably in the center between the hearing aids.

In an embodiment of the hearing aid system the facility for recognizing the wearer's own voice can be designed to recognize a signal from the wearer's own voice on the basis of a frequency distribution of the first and/or the second electrical signal.

Due to the influences of the head on the propagation of sound the wearer's own voice has a particular frequency characteristic which distinguishes the voice from the voices of other persons and facilitates recognition. This applies in particular to frequency components which are transmitted as structure-borne sound.

With the above and other objects in view there is also provided, in accordance with the invention, a method of adjusting a hearing aid system, the hearing aid system having:

a first hearing aid and a second hearing aid, the first hearing aid having a first acousto-electric converter and the second hearing aid having a second acousto-electric converter; and a signal processing unit having a signal link with the first and the second acousto-electric converters;

the method comprising the following steps:

providing the hearing aid system with a facility for recognizing the wearer's own voice, the facility for recognizing the wearer's own voice having a signal link with the first and the second acousto-electric converter;

acquiring with the first and second acousto-electric converters a first and a second acoustic signal, and signaling with the facility for recognizing the wearer's own voice signals a recognition of a signal from the wearer's own voice to the signal processing unit, and converting the first and second acoustic signals into a first electrical signal and a second electrical signal;

determining signal deviations caused by the first and second acousto-electric converter in the first and/or second electrical signals on the basis of the first and second electrical signals from the wearer's own voice; and compensating for the signal deviations of the first and the second electrical signals in the signal processing unit.

Other features which are considered as characteristic for the invention are set forth in the appended claims.

Although the invention is illustrated and described herein as embodied in a method of binaural microphone adjustment by way of the wearer's own voice, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
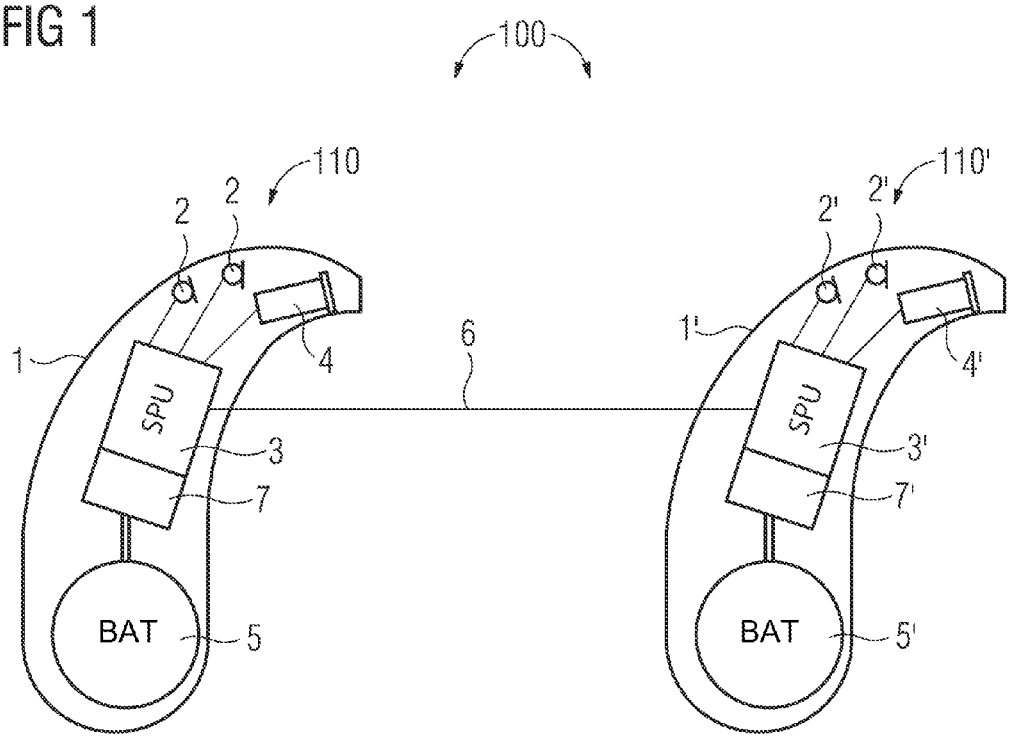
FIG. 1 is a schematic illustration of a hearing aid system according to the invention.

Referring now to the figures of the drawing in detail and first, particularly, to FIG. 1 thereof, there is shown a basic structure of a hearing aid system 100 according to the invention. The hearing aid system 100 comprises two hearing aids 110, 110'. One or more microphones 2, 2' for receiving the sound or acoustic signals from the surroundings are incorporated into a hearing aid case 1, 1' for wearing behind the ear. The microphones 2, 2' are converters 2, 2' for converting the sound into first audio signals. A signal processing unit (SPU) 3, 3', which is likewise integrated in the hearing aid case 1, 1', processes the first audio signals. The output signal from the signal processing unit 3, 3' is transferred to a loudspeaker or earpiece 4, 4' which outputs an acoustic signal. Where applicable, the sound is transferred by way of a sound tube, which is fixed in the auditory canal by way of an earmold, to the eardrum of the device wearer. The power supply for the hearing aid and in particular for the signal processing unit 3, 3' is provided by a battery (BAT) 5, 5' likewise integrated in the hearing aid case 1, 1'.

The hearing aid system 100 furthermore has a signal link 6 which is designed to transfer a first electrical signal from the signal processing unit 3 to the signal processing unit 3'. In this situation, provision is also made in the preferred embodiment that signal processing unit 3' also transfers a second electrical signal to the signal processing unit 3 in the opposite direction.

The signal link 6 can be implemented galvanically. In a preferred embodiment however the first and second electrical signals are converted for transfer by way of the signal link. The signal link can thus be implemented for example inductively, via Bluetooth, optically or using another wireless transmission technology.

It is furthermore conceivable to transfer the signals from a plurality of or from all microphones 2, 2' to the other hearing aid 110, 110' in each case.

In the preferred embodiment the hearing aid system 100 also has a facility 7, 7' for recognizing a wearer's own voice which has a signal link with the signal processing unit 3, 3'.

The facility 7, 7' for recognizing a wearer's own voice can, as illustrated in FIG. 1, be an integral component of the signal processing unit 3, 3'. It is however also conceivable that the facility 7, 7' for recognizing a wearer's own voice is designed as a separate unit in the hearing aid 110, 110'.

In principle, as illustrated in FIG. 1, each hearing aid can have its own signal processing unit 3, 3' and receive the signals delivered from both microphones 2, 2'. Each of the signal processing units 2, 2' is then independently capable of determining and compensating for the signal differences between the microphones 2, 2'. It is however also conceivable that only one of the hearing aids 110, 110' has a signal processing unit 3, 3' which performs the signal processing, the determination and the compensation, and forwards the resulting signal by way of the signal link 6 to the other hearing aid 110, 110'for output. The same applies to the facility 7, 7' for recognizing a wearer's own voice, which is provided either in each of the hearing aids 110, 110' in each case or also only in one, jointly for both hearing aids 110, 110'.

Figure 2:
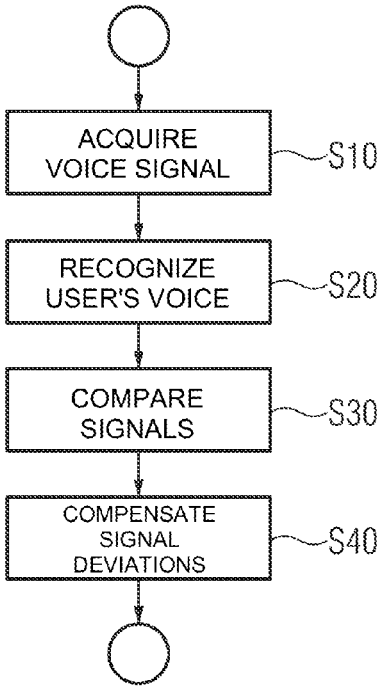
FIG. 2 shows a flowchart of a method according to the invention for operating a hearing aid system.

FIG. 2 shows a schematic flowchart of a method according to the invention in the signal processing unit 3, 3'.

The method comprises a step S10 for acquiring a first and a second acoustic signal for the own voice of the wearer of the hearing aid system by means of the first and second acousto-electric converters 2, 2'. In this situation the acousto-electric converters 2, 2' or microphones 2, 2' convert the first and second acoustic signals into first and second electrical signals.

In a step S30 a signal processing unit determines signal deviations caused by the first and second acousto-electric converters. Said deviations can exist between the first and second electrical signals in respect of the amplitude, the phase and the frequency response or arbitrary combinations thereof. The signal processing unit 3, 3' can acquire said deviations for example by means of level meters, filter banks and/or digital signal processing methods such as Fourier transforms.

In a step S40 the signal processing unit 3, 3' compensates for the determined signal deviations. In the case of an amplitude deviation this can for example take place by means of a frequency-dependent amplification of the signal in question. A phase deviation can be compensated for by means of a similarly frequency-dependent delay. In a preferable manner the compensation similarly takes place using the methods of digital signal processing.

The determined parameters for the compensation are preferably stored in the signal processing unit 3, 3' and used for processing the first and second electrical signals until step 30 is executed again.

In a preferred embodiment, in a step S20 the hearing aid system 100 according to the invention recognizes a signal from a wearer's own voice. The voice of the wearer is characterized by different particular properties. The source of the voice using larynx and mouth is thus arranged symmetrically between the ears in the case of hearing aids 110, 110' worn on the ears. This means that a high degree of symmetry of the signal is to be expected. The sound waves therefore have an almost identical phase and amplitude at the first microphone 2 and the second microphone 2'. The recognition facility 7, 7' can therefore for example associate first and second electrical signals, which have an almost identical amplitude and phase, with the wearer's own voice. Compared with signals from voices of other persons in front of the wearer, these signals exhibit a distinct frequency response and amplitude which are caused by the attenuation of the head and also by sound conduction in the head. It would also be conceivable that the microphones 2, 2' are specially designed in order to also acquire structure-borne sound, or that for example other separate converters are provided for the purpose and the wearer's own voice is recognized in this manner.

The steps S10 to S40 can be executed once or repeated in each case independently in response to an external signal or at intervals.

Although the invention has been illustrated and described in detail by means of the preferred exemplary embodiment, the invention is not restricted by the disclosed examples and other variations can be derived therefrom by the person skilled in the art without departing from the scope of protection of the invention.

The invention claimed is:

1. A hearing aid system to be worn by a hearing aid wearer, the hearing aid system comprising:

a first hearing aid and a second hearing aid, said first hearing aid having a first acousto-electric converter configured to convert an incoming acoustic signal into a first electrical signal, and said second hearing aid having a second acousto-electric converter configured to convert a second incoming acoustic signal into a second electrical signal;

a signal processing unit connected, by way of a signal link, with said first and second acousto-electric converters;

said signal processing unit being configured to determine and to compensate for signal deviations between the first and second electrical signals on the basis of the first and second electrical signals from the wearer's own voice, wherein the wearer's own voice is characterized by a symmetry of the first and second audio signals at the first and second acoustoelectric converters;

a facility configured for recognizing the wearer's own voice, said facility having a signal link with said first and the second acousto-electric converters and being configured to signal to said signal processing unit a recognition of a signal from the wearer's own voice.

2. The hearing aid system according to claim 1, wherein said facility for recognizing the wearer's own voice is configured to recognize a signal from the wearer's own voice on a basis of a level of the first and/or the second electrical signal.

3. The hearing aid system according to claim 1, wherein said facility for recognizing the wearer's own voice is configured to recognize a signal from the wearer's own voice on a basis of a phase relationship between the first and second electrical signals relative to one another.

4. The hearing aid system according to claim 1, wherein said facility for recognizing the wearer's own voice is configured to recognize a signal from the wearer's own voice on a basis of a frequency distribution of the first and/or the second electrical signal.

5. A method of adjusting a hearing aid system, the hearing aid system having:

a first hearing aid and a second hearing aid, the first hearing aid having a first acousto-electric converter and the second hearing aid having a second acousto-electric converter; and a signal processing unit having a signal link with the first and the second acousto-electric converters;

the method comprising the following steps:

providing the hearing aid system with a facility for recognizing a wearer's own voice, the wearer's own voice being characterized by a symmetry of the first and second audio signals at the first and second acoustoelectric converters, and the facility for recognizing the wearer's own voice having a signal link with the first and second acousto-electric converters;

acquiring with the first and second acousto-electric converters a first and a second acoustic signal, respectively, and signaling with the facility for recognizing the wearer's own voice a recognition of a signal from the wearer's own voice to the signal processing unit, and converting the first and second acoustic signals into a first electrical signal and a second electrical signal, respectively;

determining signal deviations between the first and second electrical signals on a basis of the first and second electrical signals from the wearer's own voice; and compensating for the signal deviations of the first and the second electrical signals in the signal processing unit.

6. The method according to claim 5, wherein the facility for recognizing the wearer's own voice recognizes a signal from the wearer's own voice on a basis of a level of the first and/or the second electrical signal.

7. The method according to claim 5, wherein the facility for recognizing the wearer's own voice recognizes a signal from the wearer's own voice on a basis of a phase relationship of the first and second electrical signals relative to one another.

8. The method according to claim 5, wherein the facility for recognizing the wearer's own voice recognizes a signal from the wearer's own voice on a basis of a frequency distribution of the first and/or the second electrical signal.

* * * * *